United States Patent [19]

Jonas

[11] Patent Number: 4,597,348

[45] Date of Patent: Jul. 1, 1986

[54] DETACHABLE KEEL FOR SMALL BOATS

[76] Inventor: Otakar Jonas, 1113 Faun Rd., Wilmington, Del. 19803

[21] Appl. No.: 742,879

[22] Filed: Jun. 10, 1985

[51] Int. Cl.[4] ..... B63B 41/00

[52] U.S. Cl. ..... 114/140; 114/347; 114/364

[58] Field of Search ..... 114/39.1, 39.2, 140, 114/127, 129, 343, 364, 347

[56] References Cited

U.S. PATENT DOCUMENTS 3,707,935 1/1973 Rachie ..... 114/102 X

FOREIGN PATENT DOCUMENTS 2522197 11/1976 Fed. Rep. of Germany ..... 114/140

2449030 10/1980 France ..... 114/140

*Primary Examiner*—Trygve M. Blix

*Assistant Examiner*—Edwin L. Swinehart

*Attorney, Agent, or Firm*—Dean R. Rexford

[57] ABSTRACT

Detachable single and multiple keels for small boats are taught which are held in place by brackets and straps, the straps being secured to the boat above the waterline.

5 Claims, 7 Drawing Figures

DETACHABLE KEEL FOR SMALL BOATS

BACKGROUND AND PRIOR ART

This invention pertains to small keelless boats. Such boats, because they offer little resistance to leeway, cannot be sailed on the wind and canoes especially are difficult to paddle on a straight course, particularly by a single paddler. Lee boards have been employed to minimize leeway in sailing canoes, but these have not been entirely satisfactory, among other reasons, because they often occupy valuable space in the vessel.

SUMMARY OF THE INVENTION

It is an object of this invention to provide readily installed, adjusted, and detached single and multiple-keel assemblies for use on keelless small boats.

A keel assembly comprises:

(a) Two or more straps having a first and a second flat side and means for securing said straps to said boat above the waterline, said strap being of a length to pass athwart the bottom of the boat with the first flat side against the boat;

(b) on the second flat side of each of said straps, one or more keels consisting of flexible bands crossing said straps on edge at about a righ angle;

(c) at each crossing a bracket, said bracket being attached to the keel and to the second flat side of the strap, so as to deploy the keel outwardly from the strap at the point of attachment, at an angle of about 45° to 90°.

DESCRIPTION OF THE PREFERRED EMBODIMENTS

According to this invention there is provided a detachable keel assembly which can be applied to a wide range of keelless boats. For example the assembly can be installed and employed on small boats up to about 25 ft. (7.6 m) overall length having bottoms ranging in shape from quite flat, as seen in some small fishing boats, to those of hard shine dingies, to bottoms which, in section, approximate a circle of beam diameter. Particular application is seen in canoes, especially white water canoes, and kayaks.

Figure 1:
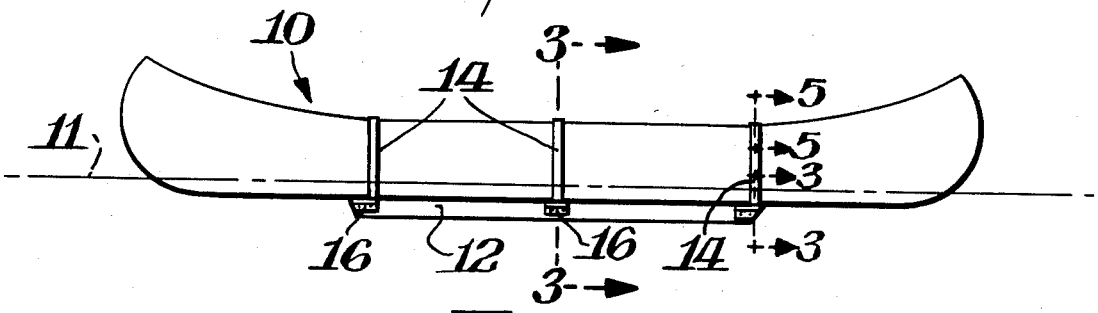
FIG. 1 is an elevation view showing one embodiment of the invention applied to a canoe.

Turning now to FIG. 1, one sees a preferred application of one embodiment of the invention, wherein a single keel is attached to canoe 10. Keel 12 is a band of material. The choice of material is not critical. Both metallic and nonmetallic materials are satisfactory. Among metallic materials, stainless steel sheet, say 1/16 in. (1.6 mm) thick, can be used and is preferred over aluminum because the latter may be attacked by salt water. Nonmetallic materials are generally preferred, however. Among this class, some satisfactory materials are reinforced figerglass, epoxy plastics, polyester resins, polyethylene, and other plastics such as poly (methylmethacrylate). Most preferred is extruded plasticized poly (vinyl chloride) and poly (acrylonitrile-butadiene-styrene) terpolymer. The cross sectional shape is preferably a simple rectangle although other shapes incorporating, for example, reinforcing ribs may be present.

The keel material, dimensions, and cross section are selected such that the installed keel does not bend excessively or break in use. These variables are readily determined by trial.

It is useful to be able to bend the keel or even roll it up for storage, for example, under the gunwale of the boat. Thus flexible materials are preferred.

The dimensions of the keel depend in part on the use to which the boat will be put. If it is intended to use the invention keel to make it easier to paddle in still water, then a 15 to 21 ft. (4.6 m -to 6.4 m) canoe might employ a ⅛ in. (3.2 mm) thick band of extruded plasticized poly (vinyl chloride) 1.5 in. (3.8 cm.) wide and 7 ft. (2.1 m) long. The dimensions are generally not critical and may be varied widely without departing from the spirit of the invention.

The above dimensions are those which one might select for use in waters where collision with underwater objects is likely. If such collision is less likely one might select a keel which is somewhat shorter, whereby to facilitate turning, and somewhat wider, say 4 ft. (1.2 m) long and about 3 in. (7.6 cm.) wide. Should one wish to sail the canoe one would employ a keel usually of somewhat greater area, and preferably somewhat shorter. Compromise between increased likelihood of collision with underwater objects will often be accepted in exchange for increased ease of handling. Such a keel might be 2 ft. (61 cm.) long and 8 in. (20 cm.) wide. The keel is normally so placed, as is known, to be more or less under the center of effort of the sails and generally at or near the midpoint of the waterline.

The keel, however selected, is attached to straps 14 via brackets 16. The straps characterized by having two flat sides may be of any flexible material of adequate strength. One might employ leather, natural or synthetic rubber, preferably fiber reinforced, plasticized poly (vinyl chloride), stainless steel strip and the like. Preferred is reinforced rubber. Some elasticity in the straps is desirable to maintain tautness in the straps.

At least two straps are needed to hold the keel in position. Depending on the stiffness and length of the keel, more straps will be used. For example, a 7 ft. (2.1 m) keel would normally employ three straps as shown in drawings. Under heavy sail the same canoe might employ four straps. Straps are placed, as shown in figures, with one flat side against the boat.

For convenience in installing and adjusting the keel, straps 14 are secured to the canoe above the water line.

In some cases it may be desirable simply to attach the two ends of a strap to each other, for example, by means of a buckle. As the keel in this embodiment is ultimately held in place by friction of the strap on the boat and the straps are buckled, for example, above the waterline, this embodiment is intended to fall within claims directed to the straps being secured above the waterline, as described below.

Figure 6:
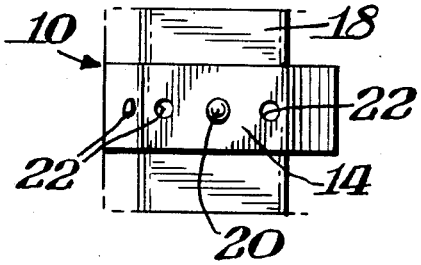
FIG. 6 shows the features of FIG. 5 in top plan view.

Various means may be used for securing the straps to the boat, e.g. the gunwale, such as cleats of various kinds, as are known to the seaman, buckles, snap fasteners and the like. As illustrated in FIGS. 1, 5, and 6, the straps are secured by means of button 20 attached to gunwale 18. One of the the holes 22 is drawn over button 20 thus securing the strap. Keel 12 is attached on edge to straps 14 via bracket 16. Various means may be employed for attachment such as cementing, screwing, or, as illustrated, in FIG. 4, by riveting.

Figure 4:
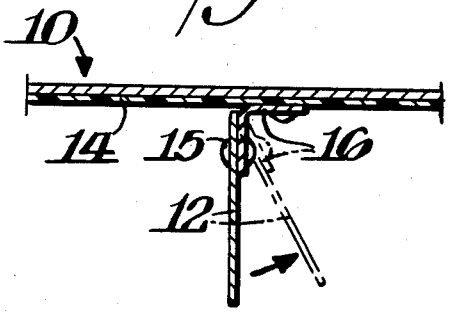
FIG. 4 shows the features of FIG. 3 in greater detail and, in broken lines, demonstrates sidewise displacement of the keel by elastic bending of the bracket as would occur, for example, on collision with an underwater object. Especially when double keels are employed as shown in FIG. 7, the bracket may be so selected as to deploy the keel outward to as much as about 45° from vertical. In a double keel embodiment as described, the keel shown in broken line in FIG. 4 would represent the starboard keel. Double keels may thus be splayed outward making easier the beaching of the boat.
Figure 5:
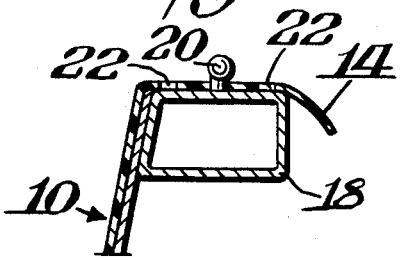
FIG. 5 is a cross sectional view taken at plane 5—5 of FIG. 1 showing one means for securing a strap to the boat above water line 11.

An important advantage is conferred on the invention assembly by selecting bracket 16 to be flexible so that on collision, with, for example, an underwater object, the keel can yield, as shown in FIG. 4, without damage to the keel or the canoe. The bracket can be selected from various materials such as stiff rubber, flexible plastic such as poly (ethylene) in thick section, or, as is perferred and illustrated, spring steel.

Figure 3:
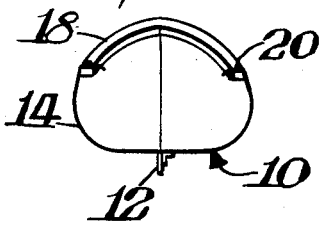
FIG. 3 is a cross sectional view taken at plane 3—3 of FIG. 1 showing an arrangement of keel, flexible bracket and strap in accordance with the invention.
Figure 7:
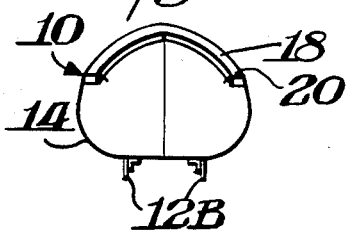

The arrangement of elements are here described results in the single-keel configuration of FIG. 3 wherein the bow or stern sections are shown as items 18. The invention is not limited, however, to embodiments comprising a single keel. Using the same materials and methods, two parallel keels 12B can be provided as illustrated in FIG. 7. Furthermore, the double keels 12B may be oriented outwardly as shown in FIG. 4 in broken line such that keels makes an angle with the vertical of about 45°. This embodiment, which is comprised in claims has distinct advantage to the boatman who must beach his boat from time to time.

In some cases it may be useful, for example on flat bottom motor powered boats, to use more than two keels, possibly as many as five.

Figure 2:
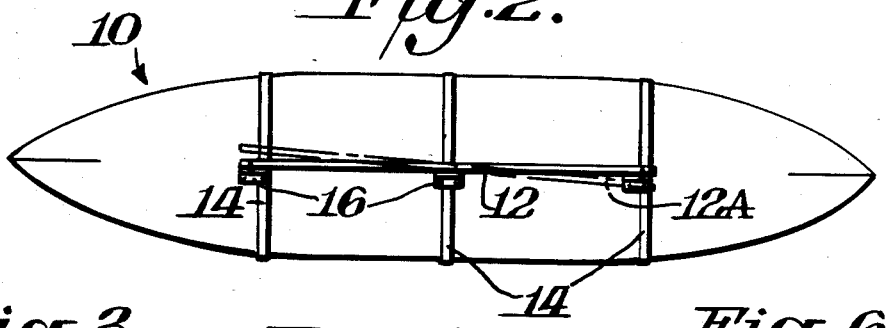
FIG. 2 is a bottom plan view of the same canoe showing, in broken lines, an assymetric placement of the keel, for example, to correct the assymetric thrust of a single paddler.

The single paddler in say a white water canoe normally maintains a straight course only with expenditure of considerable effort because of windage on the freeboard and unsymmetrical thrust from the single paddle. FIG. 2 illustrates a strategy; for overcoming this problem wherein the keel itself counteracts the forces causing the canoe to go off course. In the embodiment of FIG. 2, the canoeist has displaced the forward and aft straps. He could also achieve similar effect by displacing only the forward strap and bending the keel.

The keels are removed by reversal of the installation process.

Although this invention has been illustrated in connection with canoes, it is understood that other boats within the limits set out above can benefit equally well from application of the invention principles.

I claim:

1. A keel assembly for installation on a canoe having a gunwale comprising:

(a) two or more straps each having a first and a second flat side and means for securing said straps to the gunwale of said canoe, said straps being of a length to pass athwart the bottom of the canoe with the first flat side against the canoe;

(b) on the second flat side of each of said straps, one or more keels consisting of flexible bands, their longest dimension oriented longitudinally, and crossing said straps at edge at about a right angle;

(c) at each crossing a flexible bracket, said bracket being attached to the keel and to the second flat side of the strap, so as to deploy the keel outwardly from the strap at the point of attachment, at an angle of about 45° to 90° and to permit said flexible bracket to yield on collision with an underwater object, the straps of (a) being so attached to the gunwale as to permit displacement of one end of the keel of (b) whereby to bend said flexible keel so as to counteract freeboard windage and unsymmetrical thrust from a single paddle.

2. A keel assembly of claim 1 wherein the keel is a band of material selected from the group consisting of stainless steel, aluminum, reinforced fiberglass, epoxy plastics, polyester resins, polyethylene, poly (methylmethacrylate), plasticized poly (vinyl chloride) and poly acrylonitrile-butadiene-styrene) terpolymer.

3. A keel assembly of claim 1 having one keel.

4. A keel assembly of claim 1 having two or more keels.

5. A keel assembly of claim 1 having two keels splayed outwardly.

* * * * *